US007337794B2

(12) United States Patent
Brigham et al.

(10) Patent No.: US 7,337,794 B2
(45) Date of Patent: Mar. 4, 2008

(54) METHOD AND APPARATUS FOR THE DELIVERY OF COMPRESSED GAS IN THE FIELD

(75) Inventors: Willaim Brigham, Huntington Beach, CA (US); Saad Hassan M. Alghurairi, Alkhobar (SA)

(73) Assignee: Medra Arabia Trading, Dammam (SA)

( * ) Notice: Subject to any disclaimer, the term of this patent is extended or adjusted under 35 U.S.C. 154(b) by 74 days.

(21) Appl. No.: 11/244,910

(22) Filed: Oct. 5, 2005

(65) Prior Publication Data

US 2007/0074764 A1 Apr. 5, 2007

(51) Int. Cl.
*F17D 1/00* (2006.01)

(52) U.S. Cl. ..... 137/1; 137/266; 137/255

(58) Field of Classification Search ..... 137/266, 137/255, 256, 1

See application file for complete search history.

(56) References Cited

U.S. PATENT DOCUMENTS 5,562,776 A * 10/1996 Sapru et al. ..... 427/250
5,673,735 A * 10/1997 Crvelin et al. ..... 137/256
6,051,183 A * 4/2000 Morando ..... 266/227
6,418,962 B1 * 7/2002 Wozniak et al. ..... 137/266

* cited by examiner

*Primary Examiner*—Kevin Lee
(74) *Attorney, Agent, or Firm*—Myers Dawes Andras & Sherman LLP

(57) ABSTRACT

The invention is a method and apparatus for delivering large volumes of nitrogen gas, air, or other gas at high pressures from banks of high pressure cylinders and releasing that gas at the rate required by the operation. Not only can higher flow rates be achieved, but the absence of motors or engines can be an advantage in hazardous areas and can increase the reliability of the delivery of the gas. In addition, as compared to using liquid nitrogen, which typically must be delivered from a remote air separation plant, these banks of cylinders can then be recharged with gas by portable compressors or nitrogen generators.

23 Claims, 2 Drawing Sheets

METHOD AND APPARATUS FOR THE DELIVERY OF COMPRESSED GAS IN THE FIELD

BACKGROUND OF THE INVENTION

1. Field of the Invention

The invention relates to the field of methods and apparatus for the delivery of compressed gas for, inter alia, industrial or pipeline uses.

2. Description of the Prior Art

Nitrogen, air or other gas is used to service pipelines, tanks, or other items for the purpose of performing maintenance or some other operations. Typically dry air, nitrogen, or other gas is used, for example, to inert or dry pipelines 16 (FIG. 1), or to propel pigs for cleaning or inspecting pipelines 16. This dry air or nitrogen usually comes from either large motor or engine driven compressors 1 (FIG. 1), from nitrogen gas generators 1, which have a limited flow rate capability, or from liquid nitrogen which must be delivered to the site in sufficient quantities for the operation and then be pumped and vaporized with motor or engine driven pumps and heating equipment at the rate required by the application at hand. Nitrogen is the preferred gas to use for these applications due to its inherent nature of being relatively inert and very dry.

Time and cost are two major factors in determining what process to use in performing any of the operations. The fastest way to perform any of the operations is to obtain the highest flow rate of gas possible. In the current state of the art, this usually means using liquid nitrogen, which is the most expensive, equipment intensive and logistically difficult means.

The use of liquid nitrogen has been the preferred method of delivering gas for these applications because very high flow rates can be achieved at pressure required. When this method is used, the amount of gas must be estimated so that sufficient liquid nitrogen is available to complete the job. The disadvantages of this approach are the expense and logistics required for the supply and transportation of the liquid nitrogen, and the special equipment required to pump and vaporize the cryogenic medium.

The use of electric motor or engine driven compressors 1 to deliver the required gas (plus a nitrogen generator if necessary), although capable of delivering unlimited amounts of gas at a relatively low cost, is limited as to the rate at which the gas can be delivered and therefore increases the time required to perform the job.

Many of the operations that require a gas supply take place in hazardous locations (NEC Class 1 Division 2, or Zone 1 or 2) where the use of engines or electric motors 1 is discouraged, restricted, or require extensive safety provisions. In these cases both the use of the liquid nitrogen equipment and the compressors 1 present a potential problem that can usually only be remedied with expensive modifications to the equipment, or by using special equipment.

BRIEF SUMMARY OF THE INVENTION

The preferred embodiment of the invention is a method and apparatus for combining the advantages of the high flow rates that can be achieved using liquid nitrogen systems, with the lower cost and longer term operational capabilities of the compressors and nitrogen generators. The illustrated embodiment of the invention is a means for supplying high flow rates of gas by releasing the gas from one or more high pressure gas storage containers 10 (often known as "tube trailers" or "tube containers"). These gas storage containers 10 are arrays of high pressure cylinders that are interconnected with a manifold and are equipped with special valves that permit the high flow rates required by the operations. Multiples of these high pressure storage containers can be used for any single operation, with full containers replacing depleted containers 10 during the operation to maintain a sustained flow rate. Depleted containers 10 can be recharged by a nitrogen generator system 1 to achieve a longer operation and to meet the total volume requirement. The recharging can be performed off the hazardous site as discussed earlier.

An added benefit of this invention is that this procedure requires no power, in the form of gas or diesel engines or electric motors 1, at the operation site. The absence of motors or engines 1 can be an advantage in hazardous areas and can increase the reliability of the delivery of the gas.

In addition, as compared to using liquid nitrogen, which typically must be delivered from a remote air separation plant, these banks of cylinders 10 can then be recharged with gas by portable compressors or nitrogen generators 1.

Although the present invention still requires an estimate of the gas required, the cylinder banks 10 can be recharged with portable compressors and/or nitrogen generators 1 at or near the job site, albeit at a lower rate than is being delivered.

Considerably higher rates can be achieved with the present invention than with electric motor or engine driven compressors. The invention is normally operated with only low voltage control signals to control and record the flow of the gas, or can be operated with no power at all.

Thus the invention is defined as an apparatus for providing delivery of compressed gas to an application comprising at least one bank of compressed gas cylinders for storing gas at a pressure equal to or exceeding a predetermined delivery pressure; and a valve for controlling flow of gas from the bank to the application.

The apparatus further comprises a flowmeter coupled to the valve for monitoring flow of gas from the bank to the application. The flowmeter is preferably coupled to the valve downstream from the valve. The bank comprises a plurality of compressed gas cylinders coupled in parallel, coupled in series or as a cascaded system.

In another embodiment the apparatus further comprises a plurality of banks of gas cylinders. A corresponding plurality of valves are coupled to the plurality of banks of gas cylinders. A corresponding plurality of flowmeters are coupled to and downstream from the plurality of valves.

In still another embodiment the plurality of banks are divided into at least two sets of banks, each set having at least one bank of gas cylinders. At least one valve is coupled to each set of banks, a flowmeter is coupled to each valve, and at least two check valves are coupled to and downstream from the valves to permit selective detachment and coupling of each set of banks to the application.

The invention must also be understood to include the method of delivering compressed gas to an application or pipeline according the a method of operation using the above defined embodiments.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 1:
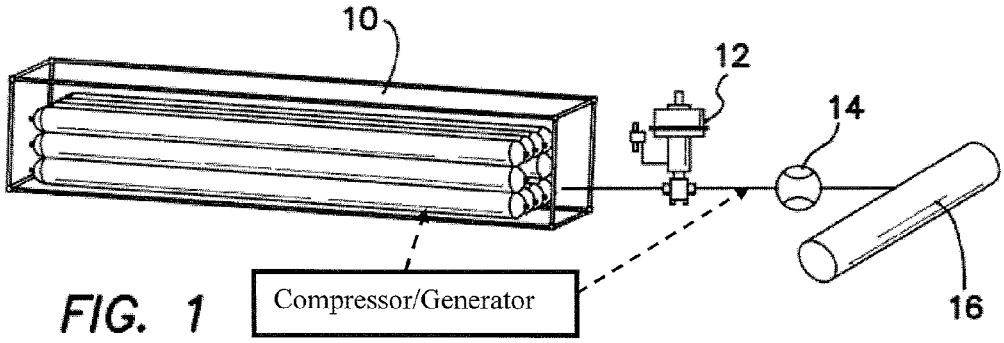
FIG. 1 is a diagram which symbolically depicts a single bank of compressed gas cylinders coupled to a valve and flowmeter to deliver gas to an application or pipeline according to the invention.

FIG. 1 is a diagrammatic depiction of a bank of high pressure cylinders 10 for storing the required gas at a pressure sufficiently higher than the required delivery pressure in the pipeline 16 or other application, so as to be able to maintain as high a flow rate as possible during delivery. Such a flow rate is substantially higher than that if the compressor/generator 1 were used to directly send gas to the pipeline 16. The bank may be mounted on a transportable skid that can be loaded onto and off of a truck, barge, train car or aircraft. Alternatively, the bank can be integrally combined with the vehicle to provide a self-propelled unit. In general, while the delivery pressure can be understood to vary widely over the spectrum of all possible applications, for most pipeline deliveries a pressure in the range of approximately 100 to 500 psi is adequate. In addition the volume of gas which can be stored in a bank is highly variable according to the number and nature of gas cylinders ganged together to comprise the bank. Normally DOT cylinders would be used with maximum pressure capabilities of 2400 psig (3T-2400 tube) or 2850 psig (3T-2850 tube). The volume of each container depends on the length and number of tubes used. Other DOT and DOT exempt cylinders of various sizes may be used with pressures up to 5000 psig, arrayed into a bank of cylinders to make up a single container. However, container volumes in the range of 70,000 cubic feet to more than 185,000 cubic feet at 2400 psi or 2850 psi and at 70° F. are typical. The compressed gas is released from the bank of cylinders 10 through one or more valves 12 that serve to control the pressure and/or the flow rate of the delivered gas. A flow meter 14 may be included to monitor and/or record the flow rate and total flow of the delivered gas. The gas is delivered to the pipeline 16 or to another process or application.

The valve 12 may be incorporated as part of the bank of high pressure cylinders 10 or on a separate small skid with the flowmeter 14. The flowmeter 14 is preferably located downstream of the valve 12. The flowmeter 14 can be incorporated as part of the bank of high pressure cylinders 10 or on a separate small skid.

Figure 2:
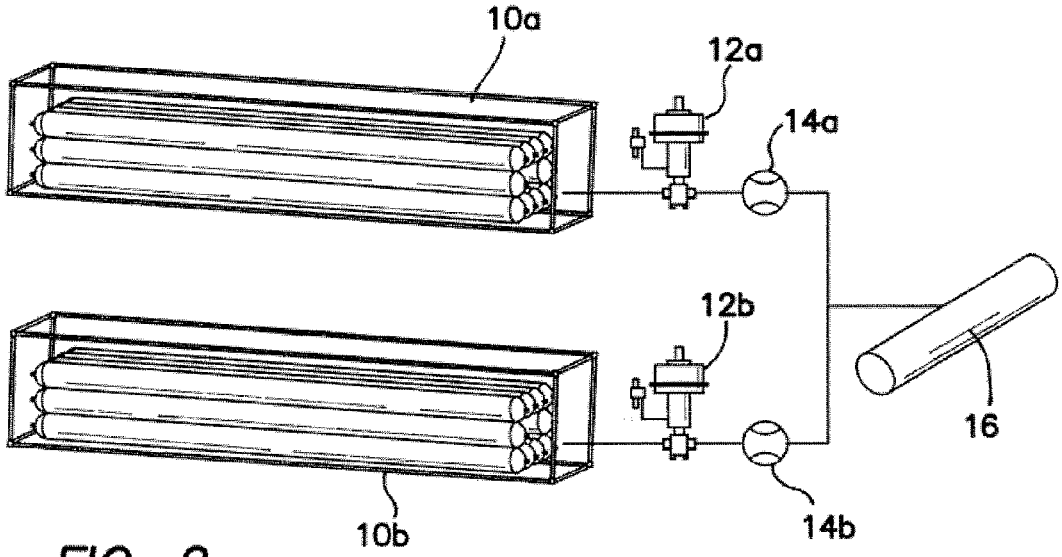
FIG. 2 is a diagram of the invention wherein a plurality of banks of cylinders are employed.
Figure 3:
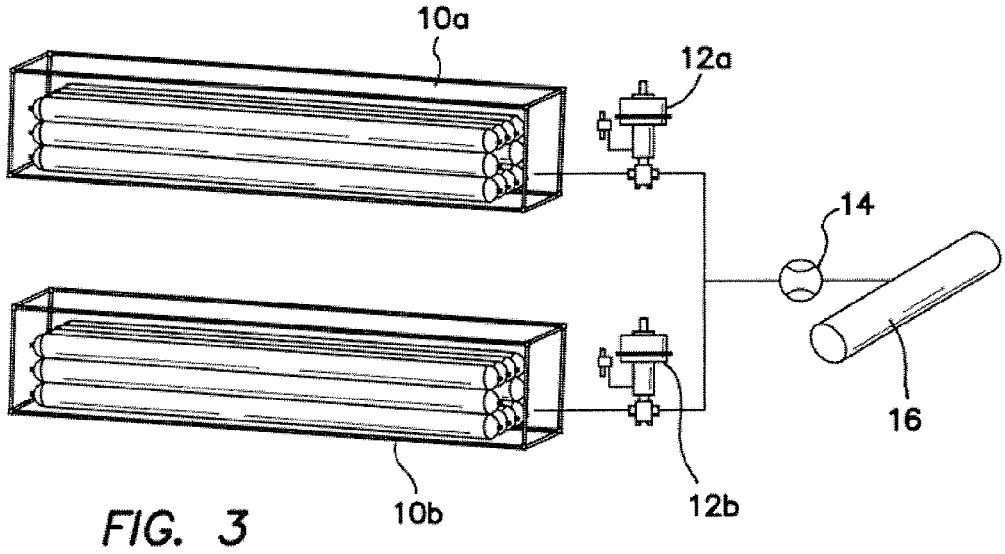
FIG. 3 is a diagram of the invention of the embodiment of FIG. 2 where the plurality of banks employ a common flowmeter.
Figure 4:
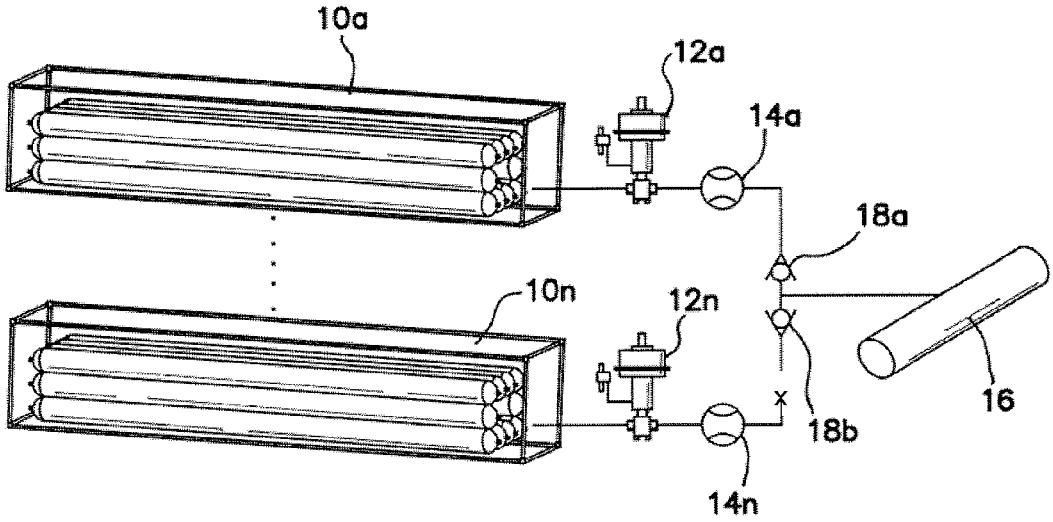
FIG. 4 is a diagram of the invention wherein a plurality of banks of cylinders are employed in at least two sets in which one set is used and then exhausted with the second set then coupled to the application or pipeline to take up the gas delivery after the first set of banks are depleted.

For higher flow rates, multiple banks of cylinders 10*a* and 10*b* may be used simultaneously delivering the gas in parallel as diagrammatically depicted in FIG. 2. Two or more banks of high pressure cylinders 10*a*, 10*b* for storing the required gas at a pressure sufficiently higher than the required delivery pressure in the pipeline 16 so as to be able to maintain as high a flow rate as possible. The gas is released from the multiple banks of cylinders 10*a* and 10*b* through one or more valves 12*a* and 12*b* respectively that serve to control the pressure and/or the flow rate of the delivered gas. A flow meter 14*a* and 14*b* may be included to monitor and/or record the flow rate and total flow of the delivered gas through valves 12*a* and 12*b* respectively. The gas is delivered to the pipeline 16 or to another process or application. Valves 12*a* and 12*b* may be incorporated as part of each bank of high pressure cylinders 10*a* and 10*b* respectively or on a separate skid with flowmeters 14*a* and 14*b* respectively to control and measure the flow of gas from the multiple banks of cylinders 10*a* and 10*b*. The flowmeters 14*a* and 14*b* are preferably located downstream of the valves 12*a* and 12*b*. The flowmeters 14*a* and 14*b* can be incorporated as part of the bank of high pressure cylinders 10*a* and 10*b* respectively or a single flowmeter 14 can be used on a separate small skid to measure the combined flow of the multiple banks of cylinders 10*a* and 10*b* as shown diagrammatically in FIG. 3. In the same way the function of valves 12*a* and 12*b* could be combined into a single valve to service banks 10*a* and 10*b*.

For long durations jobs, multiple banks 10*a* to 10*n*, where n is an arbitrary number, may be used sequentially, with one or more banks 10*a*, 10*b*, . . . delivering the gas while additional banks of cylinders . . . 10*n* are standing by ready to deliver when the operating bank(s) 10*a*, 10*b*, . . . of cylinders become depleted of gas or the pressure gets too low to maintain the desired flow rate. The gas may be delivered through one or more check valves 18*a* and 18*b* located just before the delivery point into the process 16 so that the depleted bank(s) 10*a*, 10*b*, . . . may be removed from the process while the replacement bank(s) . . . 10*n* continue the operation. The depleted banks of cylinders 10*a*, 10*b*, . . . can then be replaced with a fully charged bank of cylinders . . . 10*n*. The depleted banks of cylinders 10*a*, 10*b*, . . . can then be removed or recharged as required for continued operation. A separate check valve 18*a*, 18*b* . . . may be provided for each bank 10*a*, 10*b*, . . . 10*n* or check valve 18*a* may be coupled via a manifold to a first set of banks 10*a*, 10*b* . . . which will be depleted first and then check valve 18*b* may be coupled via a manifold to a second set of banks . . . 10*n* which will be used next.

Many alterations and modifications may be made by those having ordinary skill in the art without departing from the spirit and scope of the invention.

Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. An apparatus for providing delivery of compressed gas to a petroleum field application at a hazardous site, comprising:

at least one bank of mobile compressed gas cylinders for storing gas at a pressure sufficient for substantially completely providing all the gas required by the application wherein the at least one bank of compressed gas cylinders is charged with the gas at a location other than at the application and at a location away from the hazardous site;

means for delivering the gas at the hazardous site at a flow rate sufficiently high to provide substantially all the gas required by the application to meet a predetermined flow rate or predetermined delivery time period; and a flowmeter coupled to a valve for monitoring flow of gas from the at least one mobile bank to the application.

2. The apparatus of claim 1 where the at least one bank of compressed gas cylinders stores gas at a pressure equal to or exceeding a predetermined delivery pressure; and the means for delivering the gas comprises the valve, which is coupled to the flowmeter and to the least one bank of compressed gas, for controlling flow of gas from the bank to the application.

3. The apparatus of claim 2 where the flowmeter is coupled to the valve downstream from the valve.

4. The apparatus of claim 1 where the bank comprises a plurality of compressed gas cylinders coupled in parallel.

5. The apparatus of claim 1 further comprising a plurality of banks of gas cylinders.

6. The apparatus of claim 5 further comprising a corresponding plurality of valves coupled to the plurality of banks of gas cylinders.

7. The apparatus of claim 6 further comprising a corresponding plurality of flowmeters coupled to the plurality of valves.

8. The apparatus of claim 6, wherein the flowmeter is coupled to and downstream from the plurality of valves.

9. The apparatus of claim 5 where the plurality of banks are divided into at least two sets of banks, each set having at least one bank of gas cylinders and further comprising at least one valve coupled to each set of banks, a to each valve, and at least two check valves coupled to and downstream from the valves to permit selective detachment and coupling of each set of banks to the application.

10. A method for providing delivery of compressed gas to a petroleum field application at a hazardous site, comprising:

storing gas at a pressure equal to or exceeding a predetermined delivery pressure in at least one bank of mobile compressed gas cylinders to completely provide substantially all the gas required by the application, wherein the at least one bank of compressed gas cylinders is charged with the gas at a location other than at the application and at a location away from the hazardous site; and moving the at least one bank of mobile compressed gas cylinder to the hazardous site;

delivering the gas at a flow rate sufficiently high to provide substantially all the gas required by the application to meet a predetermined flow rate or predetermined delivery time period, wherein the flow rate for delivering the gas is measured by a flowmeter coupled to a valve between the at least one bank and the application.

11. The method of claim 10 further comprising monitoring flow of gas from the bank to the application using the flowmeter.

12. The method of claim 11 where monitoring flow of gas from the bank to the application is performed downstream from the valve where flow of gas from the bank to the application is controlled.

13. The method of claim 10 where storing gas at a pressure equal to or exceeding a predetermined delivery pressure comprises storing gas in a plurality of compressed gas cylinders coupled in parallel.

14. The method of claim 10 where storing gas at a pressure equal to or exceeding a predetermined delivery pressure comprises storing gas in a plurality of a plurality of banks of gas cylinders.

15. The method of claim 14 where controlling flow of gas from the bank to the application compressing controlling flow of gas by means of a corresponding plurality of valves coupled to the plurality of banks of gas cylinders.

16. The method of claim 15 further comprising monitoring flow of gas from the bank to the application by means of a corresponding plurality of flowmeters coupled to the plurality of valves.

17. The method of claim 15 where monitoring flow of gas from the bank to the application by means of a corresponding plurality of flowmeters comprises monitoring the flow of gas downstream from the plurality of valves.

18. The method of claim 14 where storing gas at a pressure equal to or exceeding a predetermined delivery pressure in at least one bank of compressed gas cylinders comprises storing the gas in a plurality of banks divided into at least two sets of banks, each set having at least one bank of gas cylinders and where controlling flow of gas from the bank to the application comprising selectively operating at least one valve coupled to each set of banks, monitoring the flow of gas through a flowmeter coupled to each valve, and selectively detaching and attaching each set of banks to the application through at least two check valves coupled to and downstream from the valves.

19. An apparatus used in combination with a nitrogen gas generator supplied by ambient air for providing delivery of compressed nitrogen gas to an application at a petroleum field application site, comprising:

at least one bank of mobile compressed nitrogen gas cylinders adapted to receive gas at a first flow rate from the nitrogen gas generator supplied with ambient air at a first site;

means for delivering the nitrogen gas to the application at a second flow rate at a second site, wherein the second flow rate is substantially higher than the first flow rate.

20. The apparatus of claim 19, wherein the second site is a hazardous site, and wherein the at least one bank of compressed nitrogen gas cylinders are adapted to receive nitrogen gas from the nitrogen gas generator at the first site removed from the hazardous site.

21. A method providing compressed gas to an application at a petroleum field application site, comprising:

receiving nitrogen gas at a first flow rate from a nitrogen gas generator supplied by ambient air, and storing the nitrogen gas at a pressure equal to or exceeding a predetermined delivery pressure in at least one bank of mobile compressed nitrogen gas cylinders; and delivering the nitrogen gas to the application at a second flow rate substantially higher than the first flow rate.

22. The method of claim 21, wherein the application is at a hazardous site and wherein receiving the nitrogen gas is from a nitrogen gas generator at a site removed from the hazardous site of the application site.

23. A system for providing delivery of compressed nitrogen gas to a hazardous petroleum field application, comprising:

a nitrogen gas source supplied with ambient air; and a nitrogen gas reservoir adapted to receive nitrogen gas from the nitrogen gas source at a first flow rate when removably connected to the nitrogen gas source, and to deliver compressed nitrogen gas to the application at a second flow rate substantially higher than the first flow rate, wherein the nitrogen gas reservoir receives the nitrogen gas from the nitrogen gas source at a location other than the hazardous a location of the application.

* * * * *

UNITED STATES PATENT AND TRADEMARK OFFICE

CERTIFICATE OF CORRECTION

PATENT NO. : 7,337,794 B2
APPLICATION NO. : 11/244910
DATED : March 4, 2008
INVENTOR(S) : Brigham et al.

It is certified that error appears in the above-identified patent and that said Letters Patent is hereby corrected as shown below:

Title Page
(75) Inventors: "Willaim Brigham, Huntington Beach, CA (US)" should be corrected to read "William Brigham, Huntington Beach, CA (US)".

At Column 6, Line 52: after "storing gas in" delete the first occurrence of "a plurality of".

Signed and Sealed this

Eighteenth Day of November, 2008

JON W. DUDAS
*Director of the United States Patent and Trademark Office*